US009847605B2

(12) United States Patent
Liao et al.

(10) Patent No.: US 9,847,605 B2
(45) Date of Patent: Dec. 19, 2017

(54) METHOD OF MANUFACTURING AN ELECTRICAL CONNECTOR HAVING AN INSULATIVE HOUSING FOR TWO ROWS OF TERMINALS

(71) Applicant: FOXCONN INTERCONNECT TECHNOLOGY LIMITED, Grand Cayman (KY)

(72) Inventors: Chiu-Huang Liao, New Taipei (TW); Hao-Chang Zhang, New Taipei (TW); Yung-Sheng Chu, New Taipei (TW); Wei-Ta Tseng, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/706,242

(22) Filed: May 7, 2015

(65) Prior Publication Data

US 2015/0325957 A1 Nov. 12, 2015

(51) Int. Cl.

| | |
|---|---|
| ***H01R 13/6585*** | (2011.01) |
| ***H01R 43/18*** | (2006.01) |
| *H01R 43/20* | (2006.01) |
| *H01R 24/62* | (2011.01) |

(52) U.S. Cl.

CPC ..... *H01R 13/6585* (2013.01); *H01R 43/18* (2013.01); *H01R 24/62* (2013.01); *H01R 43/20* (2013.01); *Y10T 29/4921* (2015.01)

(58) Field of Classification Search

CPC .... H01R 43/24; H01R 43/18; H01R 13/6581; H01R 13/6585; H01R 13/6591; H01R 24/62; Y10T 29/4921; Y10T 29/49224

See application file for complete search history.

(56) References Cited

U.S. PATENT DOCUMENTS

| | | | | |
|---|---|---|---|---|
| 4,269,467 | A * | 5/1981 | Hughes | H01R 13/33 29/883 |
| 6,409,543 | B1 * | 6/2002 | Astbury, Jr. | H01R 13/6587 439/607.07 |
| 7,097,506 | B2 | 8/2006 | Nakada | |
| 7,682,199 | B2 * | 3/2010 | Ahn | H01R 24/62 439/660 |
| 8,109,795 | B2 | 2/2012 | Lin et al. | |
| 8,262,411 | B2 * | 9/2012 | Kondo | H01R 13/6658 439/607.01 |
| 8,461,465 | B2 | 6/2013 | Golko et al. | |

(Continued)

FOREIGN PATENT DOCUMENTS

| | | |
|---|---|---|
| CN | 201094142 Y | 7/2008 |
| CN | 201797116 U | 4/2011 |

(Continued)

*Primary Examiner* — Peter DungBa Vo
*Assistant Examiner* — Jeffrey T Carley
(74) *Attorney, Agent, or Firm* — Wei Te Chung; Ming Chieh Chang

(57) ABSTRACT

A method of manufacturing an electrical connector including the steps of: insert-molding a base portion around a shielding plate to form two rows of passageways exposing outwardly and rearwardly; over-molding an insulative housing at a rear of the base portion; and inserting two rows of terminals through the insulative housing to the two rows of passageways, respectively.

15 Claims, 4 Drawing Sheets

(56) References Cited

U.S. PATENT DOCUMENTS

| | | | | |
|---|---|---|---|---|
| 8,684,769 | B2 * | 4/2014 | Kao | H01R 13/6471 439/607.28 |
| 8,784,134 | B2 * | 7/2014 | Wu | H01R 13/6598 439/607.05 |
| 8,794,981 | B1 * | 8/2014 | Rodriguez | H01R 13/405 439/606 |
| 2012/0178307 | A1 | 7/2012 | Yu et al. | |
| 2013/0117470 | A1 | 5/2013 | Terlizzi et al. | |
| 2013/0130549 | A1 * | 5/2013 | Wu | H01R 13/6598 439/607.01 |
| 2013/0330976 | A1 * | 12/2013 | Simmel | H01R 13/659 439/660 |
| 2015/0171562 | A1 * | 6/2015 | Gao | H01R 13/6582 439/345 |

FOREIGN PATENT DOCUMENTS

| | | | | | |
|---|---|---|---|---|---|
| CN | 203193000 | | | 9/2013 | |
| JP | 2006202645 | A | * | 8/2006 | H01R 12/716 |
| JP | 2009-176543 | A | | 8/2009 | |
| JP | 2010212249 | A | * | 9/2010 | H01R 13/518 |
| TW | M253969 | | | 12/2004 | |
| TW | M342664 | U | | 10/2008 | |
| TW | M426210 | U | | 4/2012 | |
| TW | M464851 | U | | 11/2013 | |

* cited by examiner

METHOD OF MANUFACTURING AN ELECTRICAL CONNECTOR HAVING AN INSULATIVE HOUSING FOR TWO ROWS OF TERMINALS

BACKGROUND OF THE INVENTION

1. Field of the Invention

The present invention relates to an electrical connector, and more particularly to a receptacle connector having a combined insulative housing adapted for insertion of two rows of terminals. This invention is related to the copending application Ser. No. 14/705,217 filed May 6, 2015 having the same assignee with the instant invention.

2. Description of Related Art

U.S. Pat. No. 8,262,411, issued on Sep. 11, 2012, discloses a plug connector including a housing, first and second contact groups, a conductive member, a lead connection assisting member, a shield cover, and a case. The contact groups are contained in grooves of the housing. The conductive member has a leading end portion inserted into a receiving hole of the housing to be interposed between the first and second contact groups and a rear end portion fitted in an attachment hole of the lead connection assisting member.

U.S. Pat. No. 8,684,769, issued on Apr. 1, 2014, discloses a receptacle connector and a mating plug connector. The receptacle connector includes an upper housing having an upper tongue, a set of upper contacts arranged upon the upper tongue, a lower housing having a lower tongue, a set of lower contacts arranged upon the lower tongue, and a ground plate between the upper housing and the lower housing. The upper housing and the lower housing are then inserted into a bracket. The plug connector includes a plug housing having a base portion and an upper and lower tongue portions, an upper and lower rows of contacts inserted into grooves of the housing, and a grounding plate insert-molded with the housing base portion and located between the two rows of terminals.

In another design where it is necessary to insert contacts into long and slender grooves, it may encounter difficulty in designing long and slender molding pins for forming such grooves, especially where such grooves are to be formed on a housing part of a complicated shape.

SUMMARY OF THE INVENTION

A method of manufacturing an electrical connector broadly comprises the steps of: insert-molding a base portion around a shielding plate to form two rows of passageways exposing outwardly and rearwardly; over-molding an insulative housing at a rear of the base portion; and inserting two rows of terminals through the insulative housing to the two rows of passageways, respectively. In particular, the insert-molding step further comprises exposing a rear end of the shielding plate outwardly of the base portion and the over-molding step further comprises forming a chamber at a rear of the insulative housing for accommodating the exposed rear end of the shielding plate. Therefore, the terminal grooves and the chamber need not be formed at one single molding process which is difficult.

DETAILED DESCRIPTION OF THE PREFERRED EMBODIMENT

Figure 1:
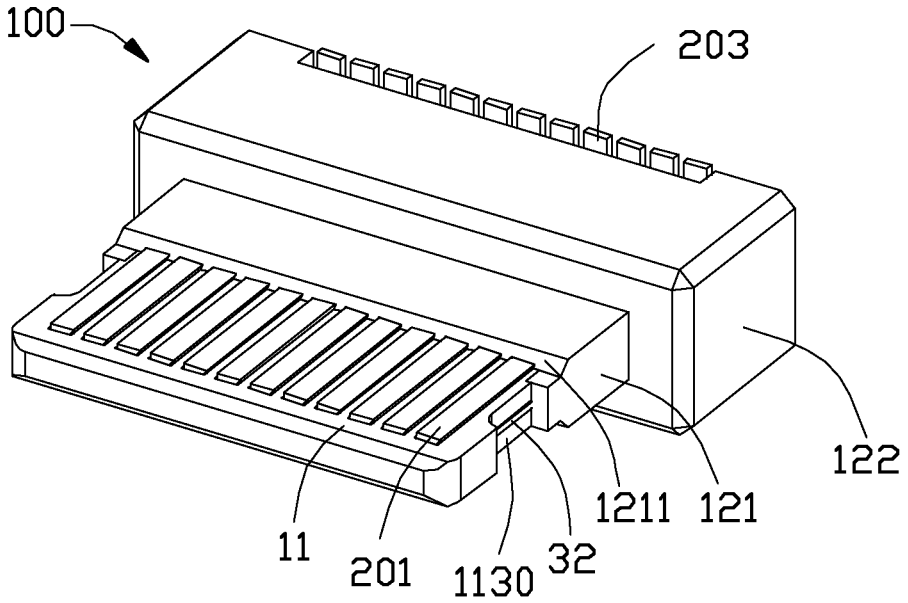
FIG. 1 is an assembled perspective view showing an electrical connector in accordance with the present invention.
Figure 2:
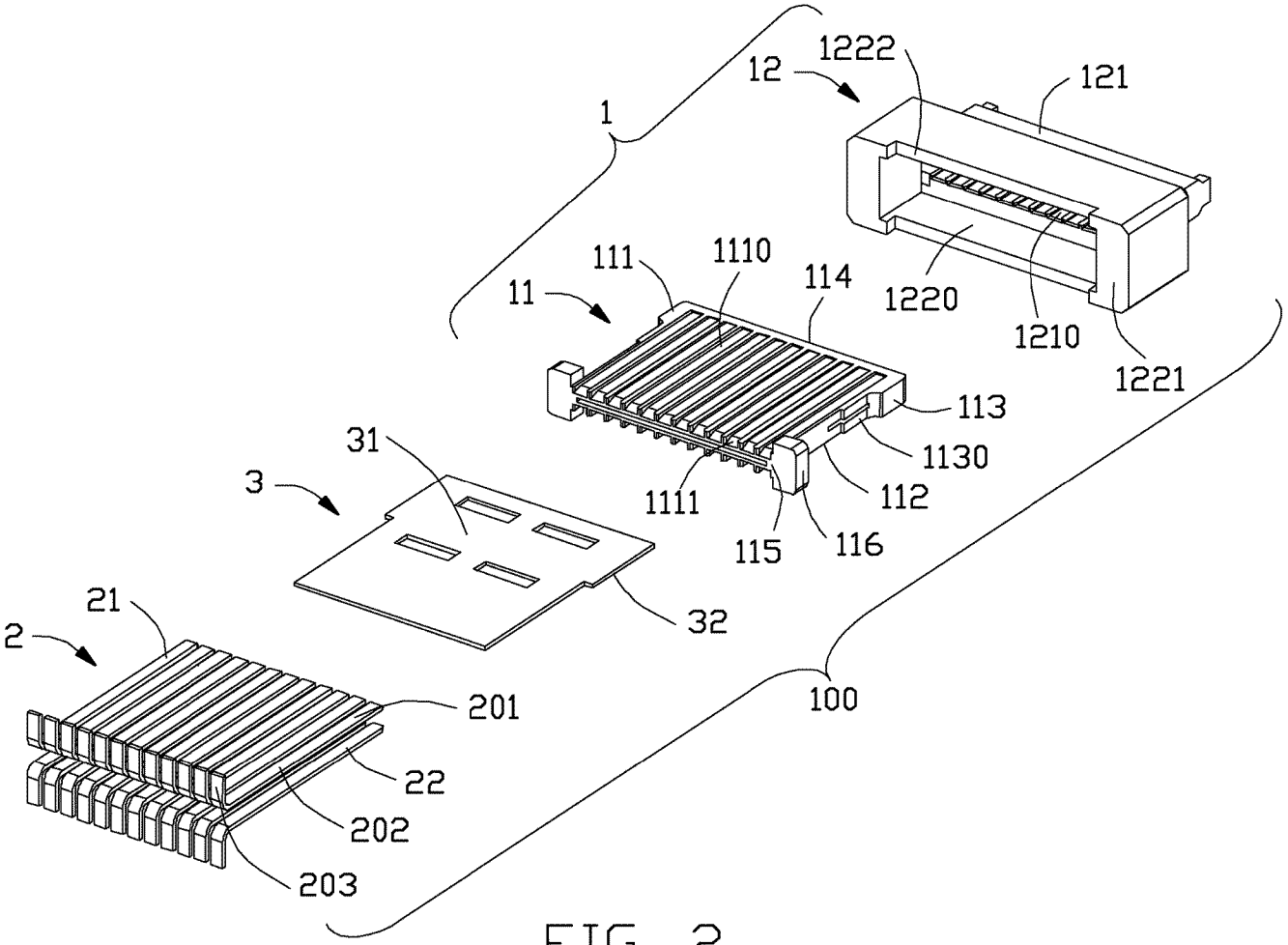
FIG. 2 is an exploded perspective view of the connector in FIG. 1.
Figure 3:
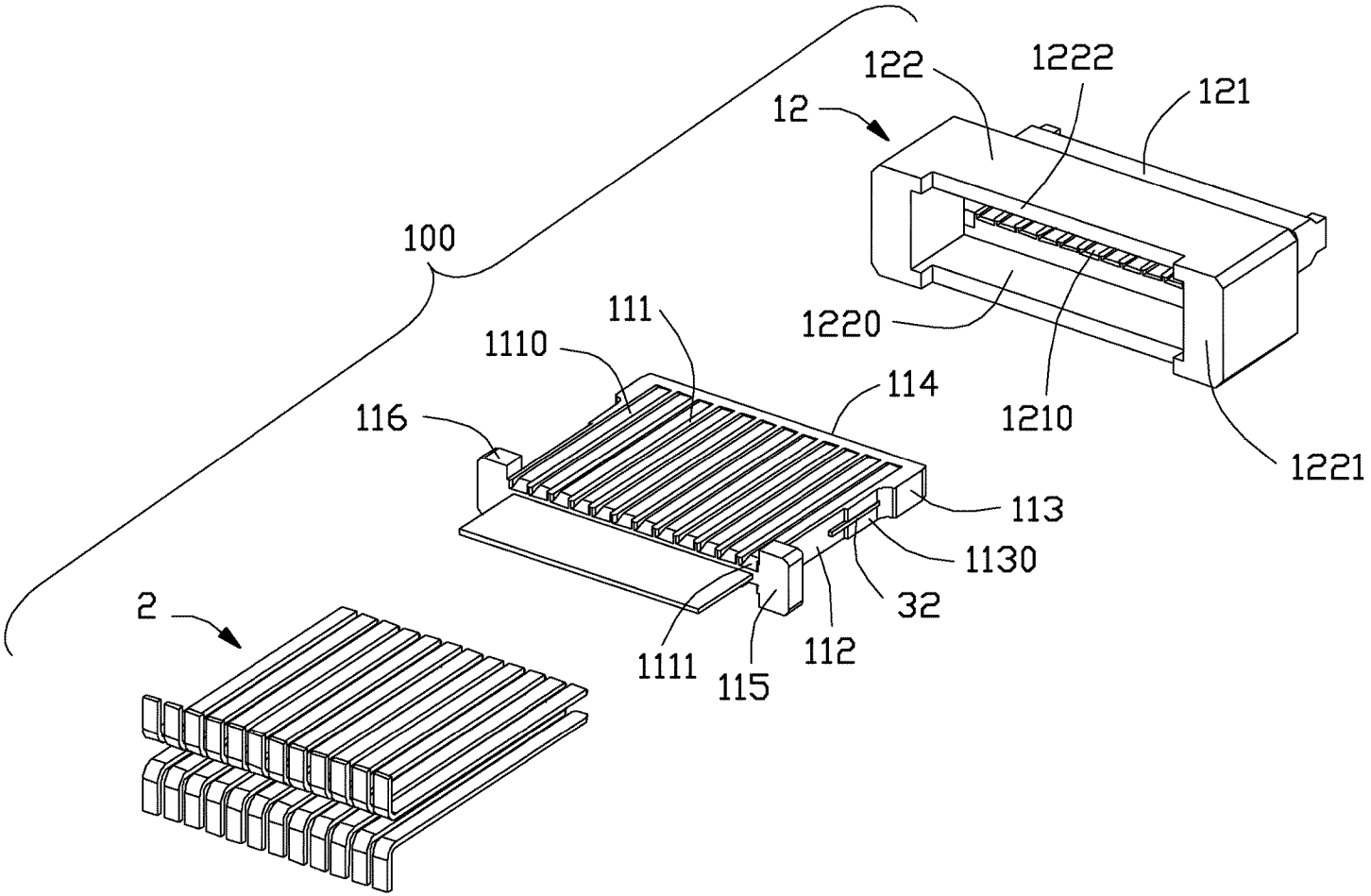
FIG. 3 is a view similar to FIG. 2 but showing a shielding plate insert molded with a base portion.
Figure 4:
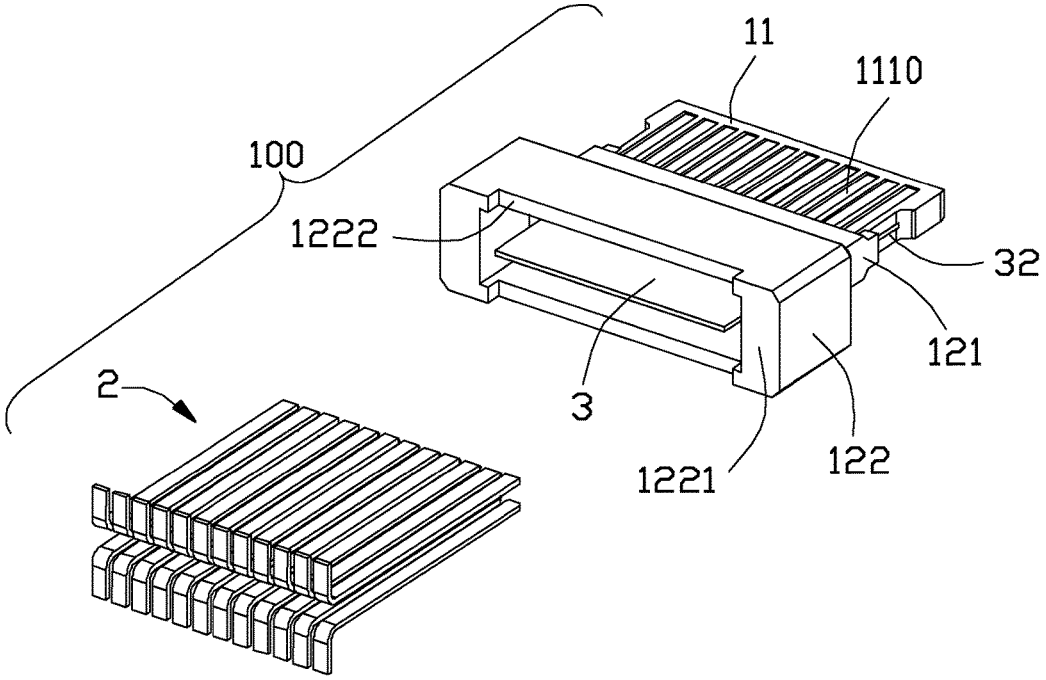
FIG. 4 is a view similar to FIG. 3 but showing an insulative housing further molded over the insert-molded shielding plate and base portion.

Referring to FIGS. 1-4, an electrical connector 100, shown as a receptacle connector omitting an outer metal shell, comprises a shielding plate 3 made from a sheet metal, a base portion 11, two rows 21, 22 of terminals 2, and an insulative housing 12. The two rows of terminals 2 are so arranged to the base portion 11 as to allow the electrical connector 100 to receive a mating plug in two orientations, i.e., reversible or flippable.

The shielding plate 3 has a main body 31 and a pair of side resisting portions 32. After insert molding, the plate 3 exposes a rear end thereof outwardly of the base portion 11.

The base portion 11 defines two rows of passageways 1110 extending along a front-to-back direction and exposed upwardly and downwardly, respectively. Each passageway 1110 exposes rearwardly and has a guiding face 1111 at a rear open end thereof. The base portion 11 has an upper face 111, an opposite lower face 112, a front face 114, a rear face 115, and a pair of side faces 113. A pair of recesses 1130 are defined at the side faces 113. A pair of protrusions 116 are provided at rear corners of the base portion 11. After insert molding, the resisting portions 32 of the plate 3 are exposed to outside through the recesses 1130.

Each terminal 2 includes an intermediate portion 202, a rear mounting portion 203, and a front contacting portion 201. The contacting portions 201 of the upper row of terminals 2 expose upwardly. The contacting portions 201 of the lower row of terminals 2 expose downwardly.

The insulative housing 12 comprises a rear portion 122 and a front portion 121. The front portion 121 has a guiding face 1211. The rear portion 122 and the front portion 121 is generally formed into a stepped configuration. The front portion 121 has a through hole 1210. The rear portion 122 has a rear face 1221, a pair of notches 1222, and a chamber 1220 in communication with the through hole 1210. The chamber 1220 accommodates the protrusions 116 of the base portion 11, the exposed rear end of the plate 3, and the angled portions 203 with the aid of the notches 1222.

A method of manufacturing the electrical connector 100 comprises the steps of: insert-molding the base portion 11 and the shielding plate 3 to form the two rows of passageways 1110 that expose both outwardly and rearwardly; over-molding the insulative housing 12 at a rear of the base portion 11 to obtain a combined housing assembly 1 with the plate 3; and inserting the two rows of terminals 2 through the insulative housing 12 to the two rows of passageways 1110, respectively. Preferably, the insert-molding step comprises exposing a rear end of the shielding plate 3 outwardly of the base portion 11 and the over-molding step comprises forming the chamber 1220 at the housing rear portion 122 for accommodating the exposed rear end of the shielding plate 3. Alternately, the housing 12 may be independently formed and successively assembled upon the base portion 11 if a contour of the base portion 11 is made with little change which allows the formed housing 12 to be assembled to the base portion 11 along the front-to-back direction.

What is claimed is:

1. A method of making an electrical connector, comprising steps of:

forming an insulative base portion, via an insert molding process, with a metallic shielding plate embedded therein and having a rear section of said shielding plate extend out of a rear side of the base portion in a front-to-back direction;

forming, via said insert molding process, a plurality of upper passageways and lower passageways exposed upon opposite upper and lower surfaces of a tongue portion of said base portion in a vertical direction perpendicular to said front-to-back direction wherein the upper passageways are arranged with one another in a transverse direction perpendicular to both said front-to-back direction and said vertical direction and the lower passageways are arranged with one another in the transverse direction;

successively applying an insulative housing circumferentially upon a rear portion of said base portion while exposing most front areas of said tongue portion in the vertical direction; and from a rear side of the base portion, successively forwardly inserting respectively a plurality of upper contacts into the corresponding upper passageways and a plurality of lower contacts into the corresponding lower passageways.

2. The method as claimed in claim 1, wherein said housing is larger than the base portion in the vertical direction and the transverse direction.

3. The method as claimed in claim 1, wherein said housing is attached to the base portion via another insert molding process.

4. The method as claimed in claim 1, wherein said housing forms a plurality of upper passages opposite to the corresponding upper passageways in the vertical direction to commonly receive the corresponding upper contacts, respectively, and a plurality of lower passages opposite to the corresponding lower passageways in the vertical direction to commonly receive the corresponding lower contacts, respectively.

5. The method as claimed in claim 1, wherein said housing forms a chamber to receive said rear section of the shielding plate.

6. A method of making an electrical connector, comprising steps of:

forming an insulative base portion, via an insert molding process, with a metallic shielding plate embedded therein, said shielding plate extending in a plane defined by a front-to-back direction and a transverse direction perpendicular to each other;

forming, via said insert molding process, a plurality of first passageways and second passageways exposed upon opposite first and second surfaces of a tongue portion of said base portion in a vertical direction perpendicular to said plane wherein the first passageways are arranged with one another in said transverse direction and the second passageways are arranged with one another in the transverse direction;

successively applying an insulative housing circumferentially upon a rear portion of said base portion while exposing most front areas of said tongue portion in the vertical direction; and from a rear side of the base portion, successively forwardly inserting respectively a plurality of first contacts into the corresponding first passageways and a plurality of second contacts into the corresponding second passageways.

7. The method as claimed in claim 6, wherein said housing is larger than the base portion in the vertical direction and the transverse direction.

8. The method as claimed in claim 6, wherein said housing is attached to the base portion via another insert molding process.

9. The method as claimed in claim 6, wherein said housing forms a plurality of first passages opposite to the corresponding first passageways in the vertical direction to commonly receive the corresponding first contacts, respectively, and a plurality of second passages opposite to the corresponding second passageways in the vertical direction to commonly receive the corresponding second contacts, respectively.

10. The method as claimed in claim 6, wherein the shielding plate includes a rear section extending out of the base portion while being received in a chamber formed by a rear portion of the housing.

11. A method of making an electrical connector, comprising steps of:

forming an insulative base portion, via an insert molding process, with a metallic shielding plate embedded therein and having a rear section of said shielding plate extend out of a rear side of the base portion in a front-to-back direction;

forming, via said insert molding process, a plurality of passageways exposed upon at least one of opposite upper and lower surfaces of a tongue portion of said base portion in a vertical direction perpendicular to said front-to-back direction wherein the passageways are arranged with one another in a transverse direction perpendicular to both said front-to-back direction;

successively applying an insulative housing circumferentially upon a rear portion of said base portion while exposing most front areas of said tongue portion in the vertical direction; and from a rear side of the base portion, successively forwardly inserting respectively a plurality of contacts into the corresponding passageways.

12. The method as claimed in claim 11, wherein said housing is larger than the base portion in the vertical direction and the transverse direction.

13. The method as claimed in claim 11, wherein said housing is attached to the base portion via another insert molding process.

14. The method as claimed in claim 11, wherein said housing forms a plurality of passages opposite to the corresponding passageways in the vertical direction to commonly receive the corresponding contacts.

15. The method as claimed in claim 11, wherein said housing forms a chamber to receive said rear section of the shielding plate.

* * * * *